US006953379B1

(12) United States Patent
Wang

(10) Patent No.: US 6,953,379 B1
(45) Date of Patent: Oct. 11, 2005

(54) TRANSMISSION ASSEMBLY FOR A DOLL

(76) Inventor: Sheng-Chien Wang, No. 120, Shen-Kang-Chung St., Shenkang Hsiang, Taichung Hsien (TW)

( * ) Notice: Subject to any disclaimer, the term of this patent is extended or adjusted under 35 U.S.C. 154(b) by 0 days.

(21) Appl. No.: 10/983,678

(22) Filed: Nov. 9, 2004

(51) Int. Cl.[7] ..... A63H 11/00
(52) U.S. Cl. ..... 446/330; 446/300; 446/354
(58) Field of Search ..... 446/300, 303, 446/314, 315, 320, 330, 331, 376, 352–354

(56) References Cited

U.S. PATENT DOCUMENTS 4,878,875 A * 11/1989 Pin-Hung et al. ..... 446/356
5,176,560 A * 1/1993 Wetherell et al. ..... 446/175
6,572,432 B1 * 6/2003 Tsai ..... 446/320
6,589,095 B1 * 7/2003 Tsai ..... 446/330
6,645,035 B1 * 11/2003 Tsai ..... 446/330
6,679,749 B2 * 1/2004 Yu ..... 446/71

* cited by examiner

*Primary Examiner*—Bena Miller
(74) *Attorney, Agent, or Firm*—Bacon & Thomas PLLC

(57) ABSTRACT

A transmission assembly for a doll includes a first driving device having a rotation sleeve adapted to be rotatably received in the top base and a twist driving element connected to the rotation sleeve to drive the rotation sleeve to twist to the right and to the left and a second driving device including a first motor, a first gear box operably connected to the first motor via a first transmission element, a first eccentric roller in connection with the first gear box and having an axle extending out of the first eccentric roller to be rotatably received in the rotation sleeve so as to drive the top base and the casing up and down and a second eccentric roller having a first linkage extending out of the second eccentric roller to drive the top base and the casing back and forth.

7 Claims, 12 Drawing Sheets

TRANSMISSION ASSEMBLY FOR A DOLL

BACKGROUND OF THE INVENTION

1. Field of the Invention

The present invention relates to a transmission assembly, and more particularly to a transmission assembly for a doll to enable the doll to move and twist.

2. Description of Related Art

A dynamic doll normally is equipped with a transmission assembly to enable the doll to move in a designed manner. The transmission assembly is able to drive the doll's head and/or limbs to move. With some accessories e.g. musical instruments attached to the arms of the doll, the movement of the doll gives the user the impression that the doll is actually playing an instrument. To some extent, the limb movement design of this doll does provide a vivid attraction to the observers, however, because most of the dolls can only move in a monotonous way, observers quickly lose interest.

To overcome the shortcomings, the present invention tends to provide an improved transmission assembly to mitigate the aforementioned problem.

SUMMARY OF THE INVENTION

The primary objective of the present invention is to provide an improved transmission assembly to enable a doll to move and twist so as to present various gyrations. In order to accomplish the aforementioned objective, the transmission assembly of the present invention includes a first driving device for driving the doll's body to twist and a second driving device for driving the doll's body to move up and down.

The first driving device includes a rotation sleeve and a twist driving element. The rotation sleeve is composed of a first sleeve, a rotation seat, a roller seat, a first support and a second support. The twist driving element is composed of a first gear box, a first motor, a first transmission element and a first linkage.

The second driving device includes a second gear box, a second motor, a second transmission element, a first eccentric roller, an axle extending out of the first eccentric roller, a second eccentric roller with a second linkage pivotally extending out of the second eccentric roller and an elevation plate connected to the first eccentric roller.

Thereby the doll is able to twist due to the provision of the first driving device and to move up and down due to the provision of the second driving device.

Other objects, advantages and novel features of the invention will become more apparent from the following detailed description when taken in conjunction with the accompanying drawings.

DETAILED DESCRIPTION OF THE PREFERRED EMBODIMENT

Figure 1:
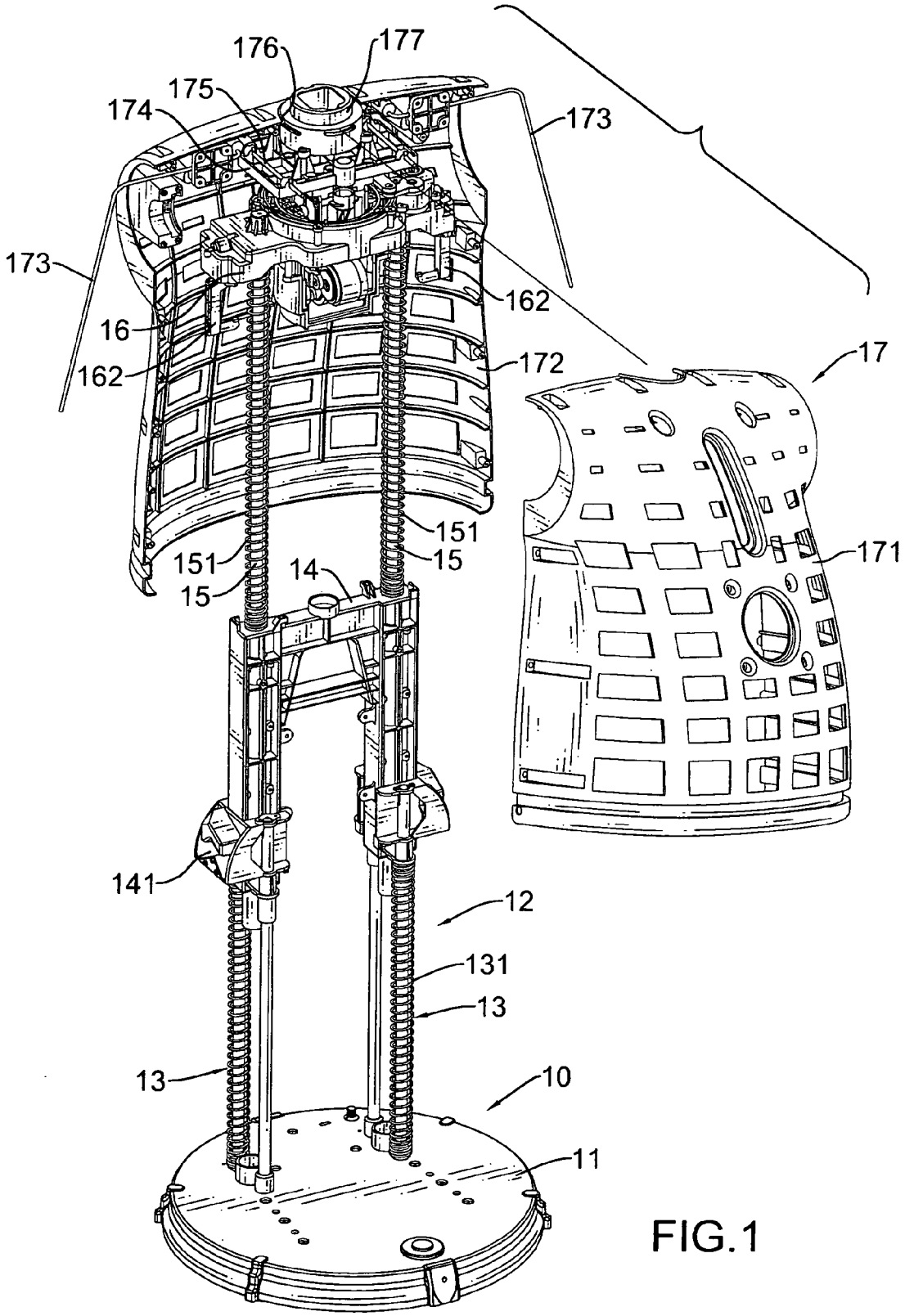
FIG. 1 is an exploded perspective view showing the skeleton of the doll of the present invention.
Figure 2:
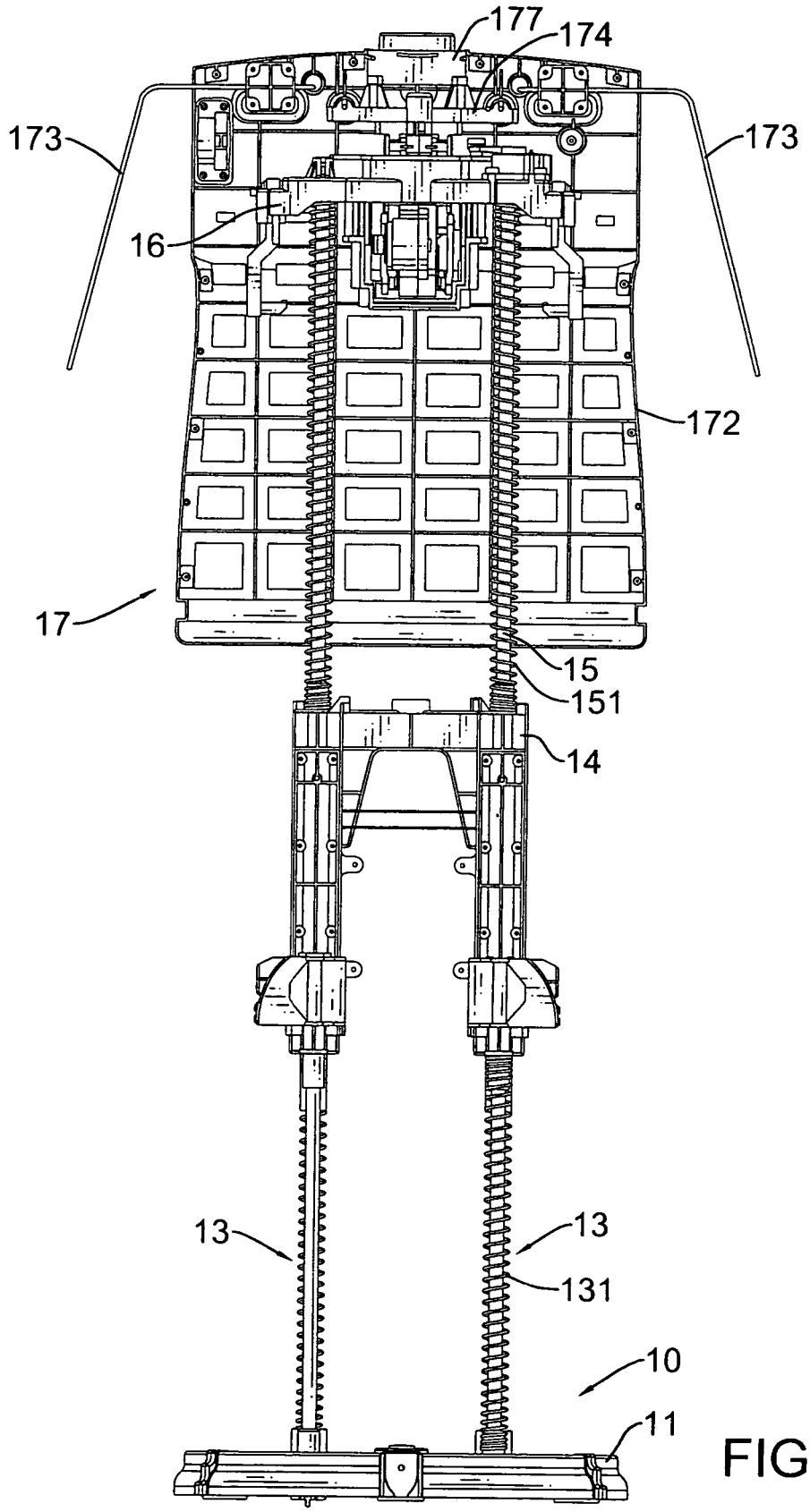
FIG. 2 is a front view showing the structure of the skeleton of the doll in FIG. 1.
Figure 3:
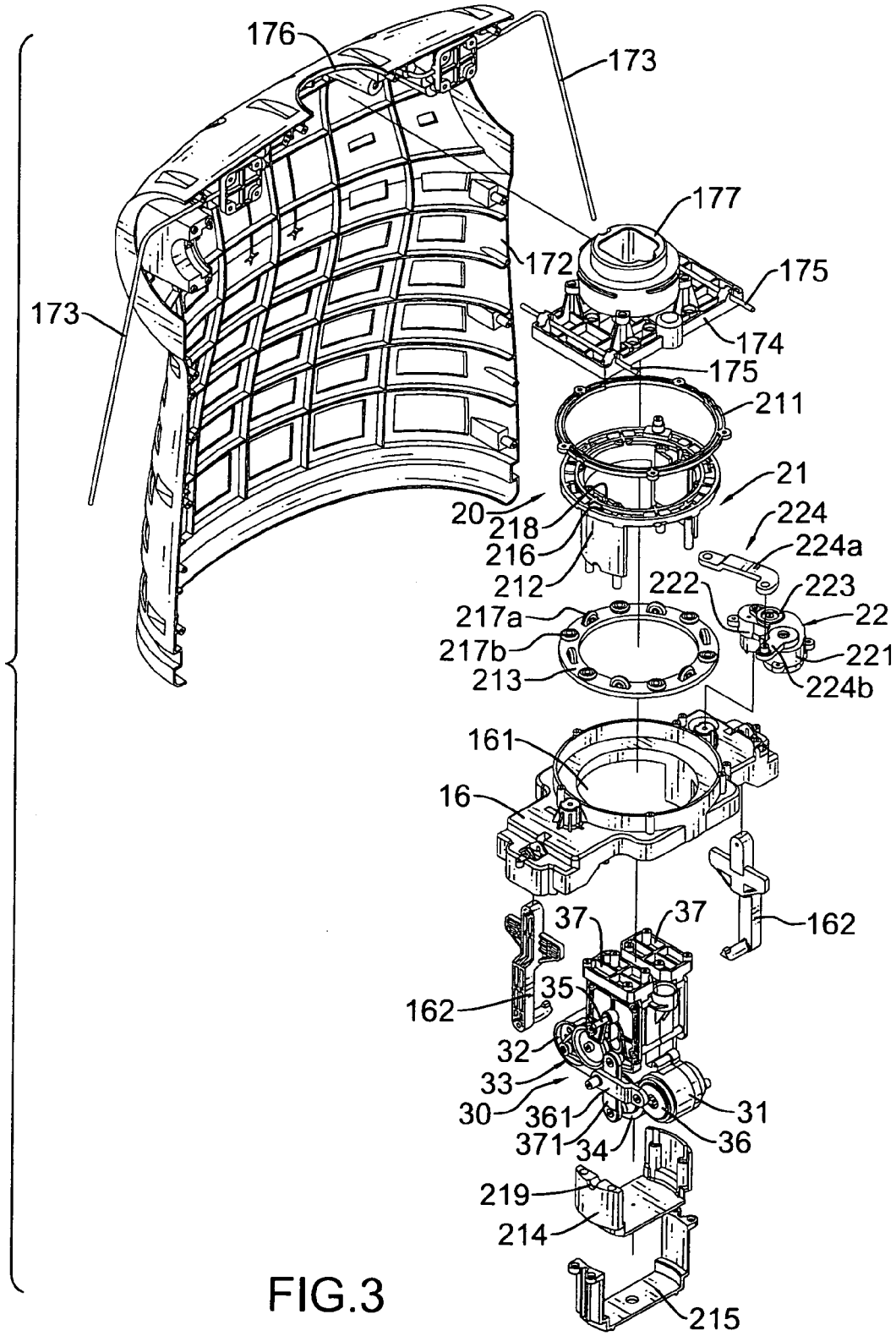
FIG. 3 is an exploded perspective view showing the transmission assembly of the present invention.

With reference to FIGS. 1 and 2, the skeleton of the doll in accordance with the present invention includes a supporting assembly (10) having a bottom base (11), a supporting bracket (12) extending upward from a top face of the base (11) and composed of bottom supporting poles (13) and top supporting poles (15), a connecting member (14) sandwiched between the bottom supporting poles (13) and the top supporting poles (15), a top base (16) securely connected to free ends of the top supporting poles (15) and having a tapered space (161) (as shown in FIG. 3) defined therein and a casing (17) securely connected to the top base (16) and composed of a front casing (171) and a rear casing (172) together with the front casing (171) to define therebetween a receiving space (not numbered) to receive therein the top base (16).

In this embodiment, it is noted that there are two bottom supporting poles (13) extending upward from the top face of the bottom base (11) and each bottom supporting pole (13) is provided with a bottom spring (131) mounted around the bottom supporting pole (13). The connecting member (14) is substantially U shaped to connect the bottom supporting poles (13) to the top supporting poles (15). The connecting member (14) is provided with two recesses (141) defined therein to correspond to hooks (162) formed on the top base (16). Each of the top supporting poles (15) is provided with a top spring (151) mounted around the top supporting pole (15). Furthermore, the bottom supporting poles (13) and the top supporting poles (15) are made of a resilient material so that impact to any part of the skeleton of the doll is able to vibrate the entire doll. A pair of arms (173) is secured to the casing (17) and the arms (173) extend from opposed sides. The casing (17) further has a connecting plate (174) sandwiched between the front casing (171) and the rear casing (172) to secure connection between the front casing (171) and the rear casing (172), two connecting shafts (175) each extending through a side of the connecting plate (174) to be opposite to one another and a head seat (177) mounted between the two connecting shafts (175) and having a hole (176) defined in the head seat (177) for connection to a head (not shown).

Figure 4:
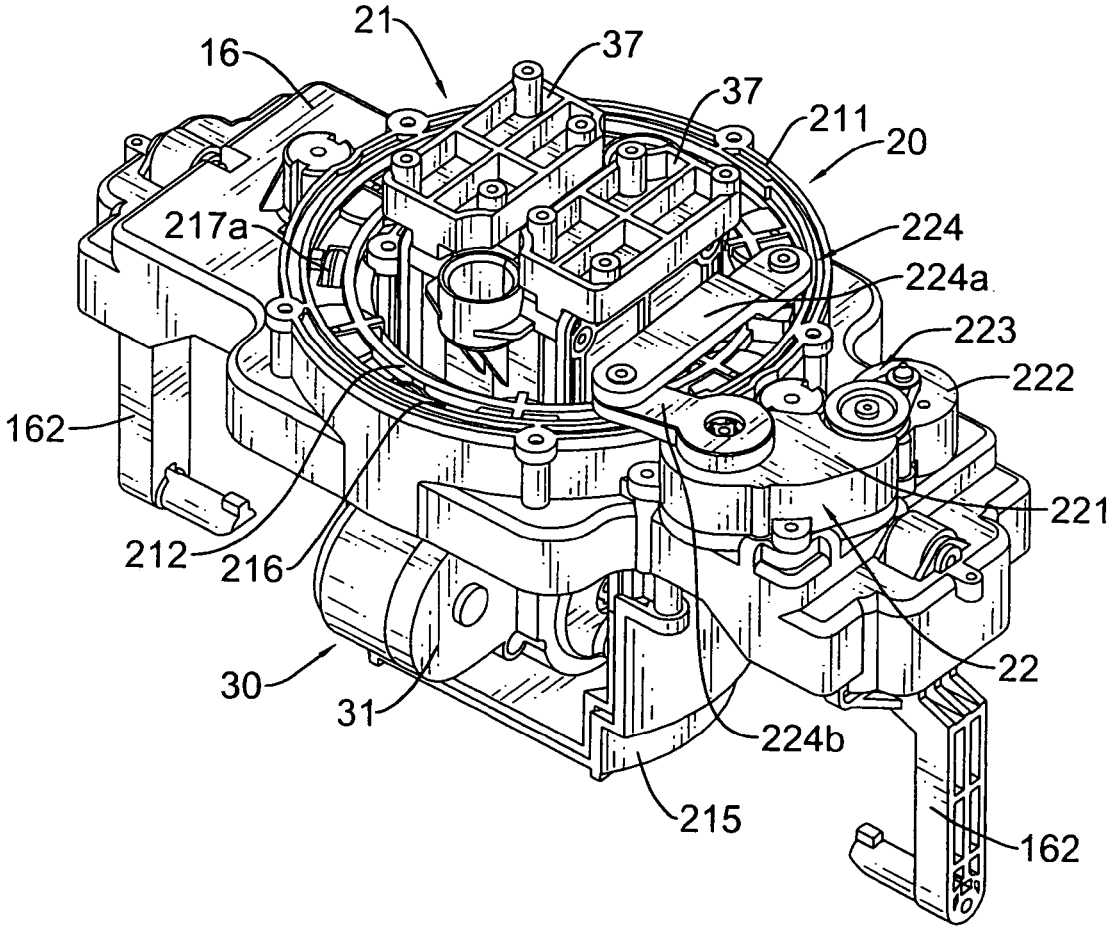
FIG. 4 is a perspective view showing that the transmission assembly is assembled.
Figure 5:
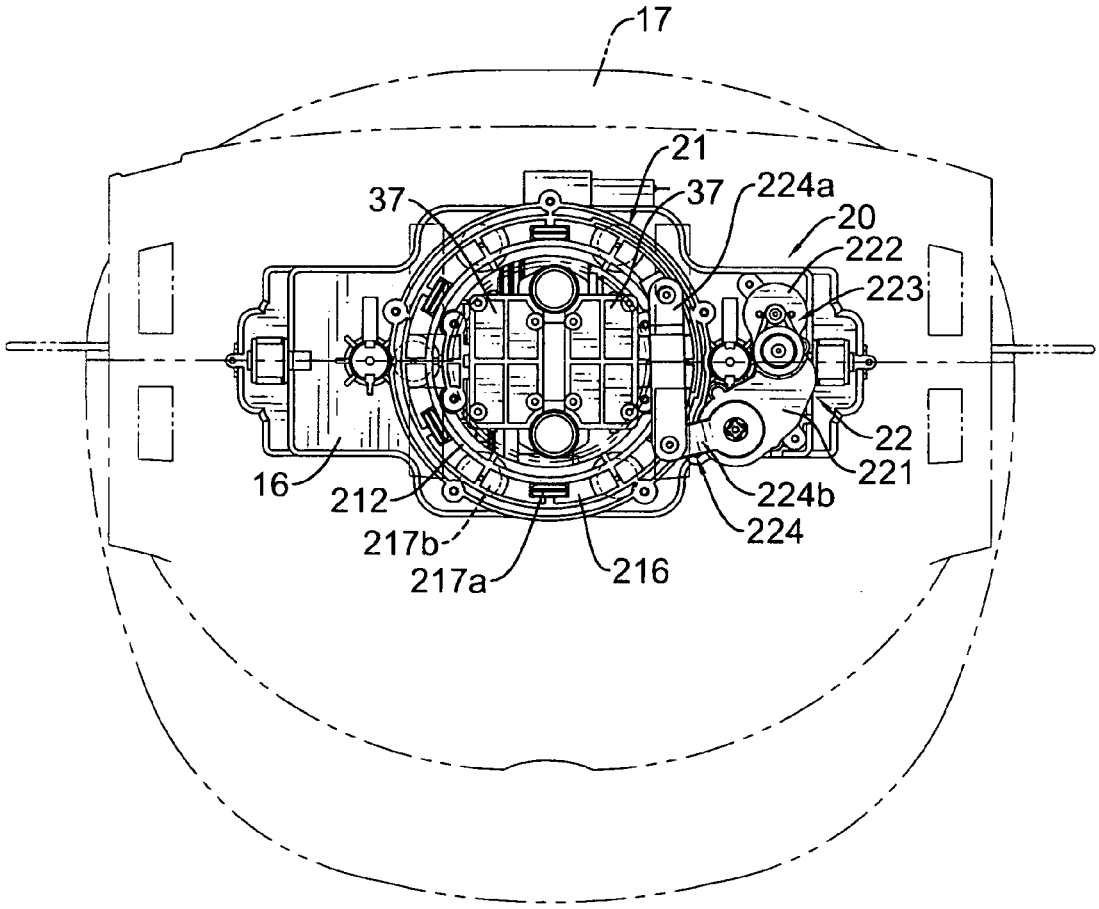
FIG. 5 is a top plan view of the assembled transmission assembly of the present invention.

With reference to FIGS. 3, 4 and 5, a first driving device (20) for driving the skeleton of the doll to twist and a second driving device (30) for driving the skeleton of the doll to move up and down are mounted on the top base (16).

The first driving device (20) has a rotation sleeve (21) and a twist driving element (22). The rotation sleeve (21) is composed of a first sleeve (211), a rotation seat (212) having the first sleeve (211) mounted thereon, a roller seat (213) securely connected to the rotation seat (212) from a bottom of the rotation seat (212), a first support (214) and a second support (215). The rotation seat (212) has a top sleeve (216) mounted on the rotation seat (212). The roller seat (213) has multiple first rollers (217*a*) lengthwise extending from a face of the roller seat (213) and multiple second rollers (217*b*) transversely extending from the face of the roller seat (213) and is securely engaged with the rotation seat (212). The first sleeve (211) is able to fixedly connect to the top base (16) to have the rotation seat (212) and the roller seat (213) securely received in the tapered space (161) of the top base (16).

The twist driving element (22) is composed of a first gear box (221), a first motor (222) operably connected to the first gear box (221) via a first transmission element (223) and a first linkage (224) to connect to the rotation seat (212). The first linkage (224) is composed of a first lever (224*a*) in pivotal connection to the top sleeve (216) and a second lever (224*b*) in connection to the first gear box (221) such that movement of the gear box (221) is able to drive the top sleeve (216) to move.

Figure 6:
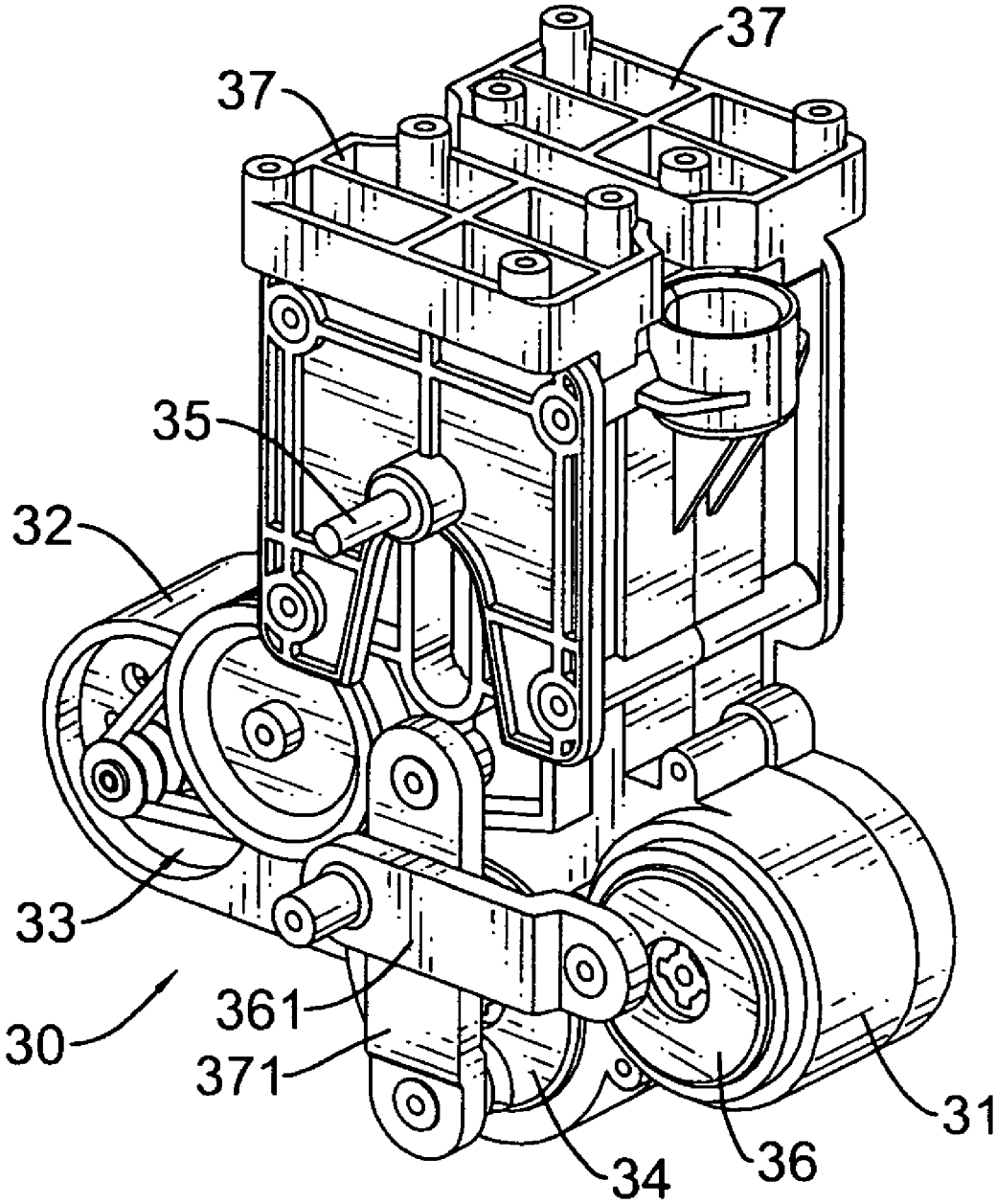
FIG. 6 is a perspective view of the second driving device of the present invention.
Figure 7:
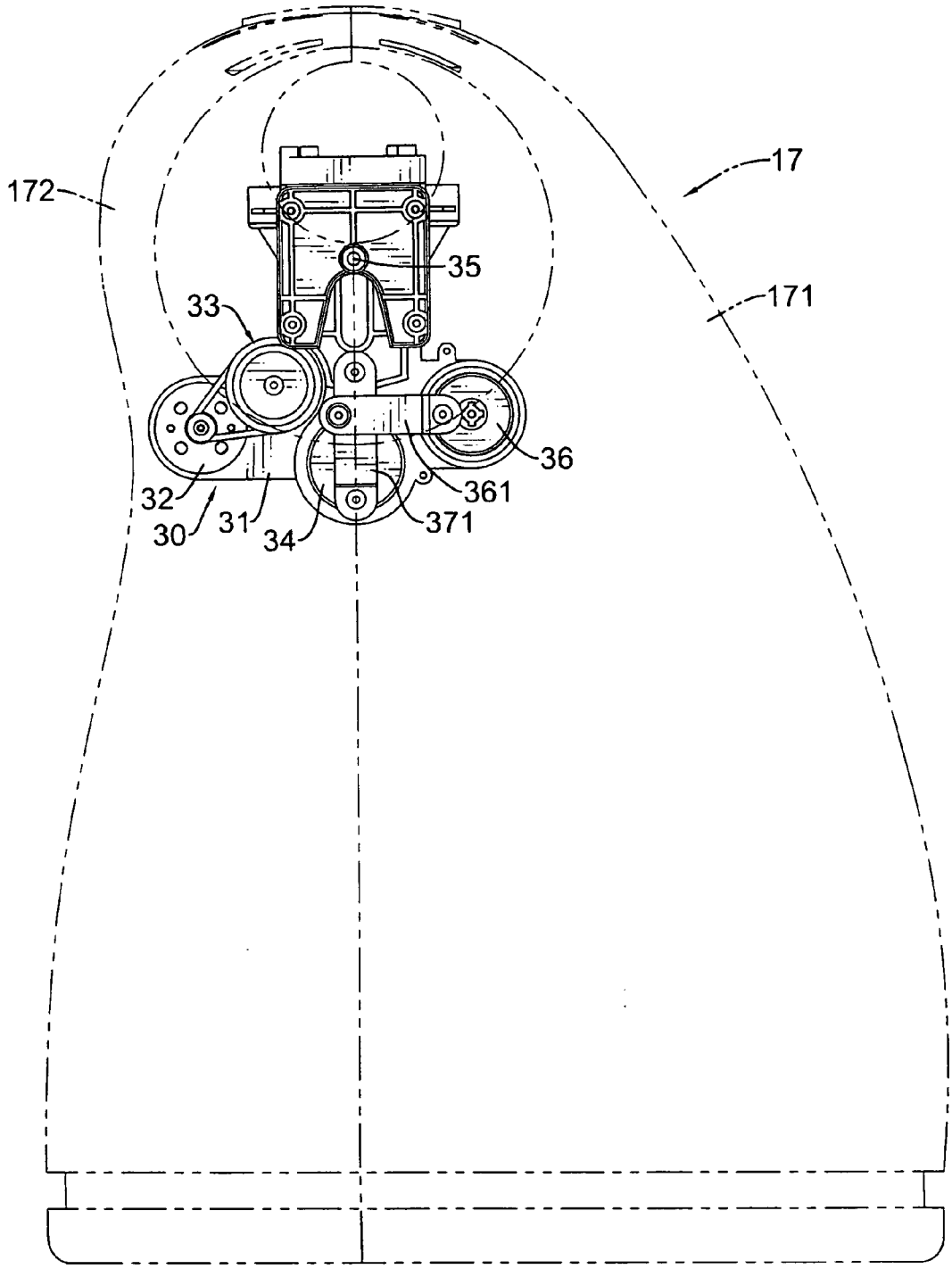
FIG. 7 is a side plan view of the second driving device of the present invention.

The second driving device (30), as shown in FIGS. 3, 6 and 7, includes a second gear box (31), a second motor (32) operably connected to the second gear box (31) via a second transmission element (33), a first eccentric roller (34) in connection to the second gear box (31), an axle (35) extending out of the first eccentric roller (34) to be rotatably received in a first recess (218) defined in a side face of the rotation seat (212), a second eccentric roller (36) with a second linkage (361) pivotally and eccentrically extending out of the second eccentric roller (36) to be rotatably received in a second recess (219) defined in a side face of the first support (214) and two elevation plates (37) connected to the first eccentric roller (34) and the connection plate (174). Each of the elevation plates (37) is provided with an elevation linkage (371) extending from a bottom of the elevation plate (37) to respectively connect to the first eccentric roller (34).

Figure 8:
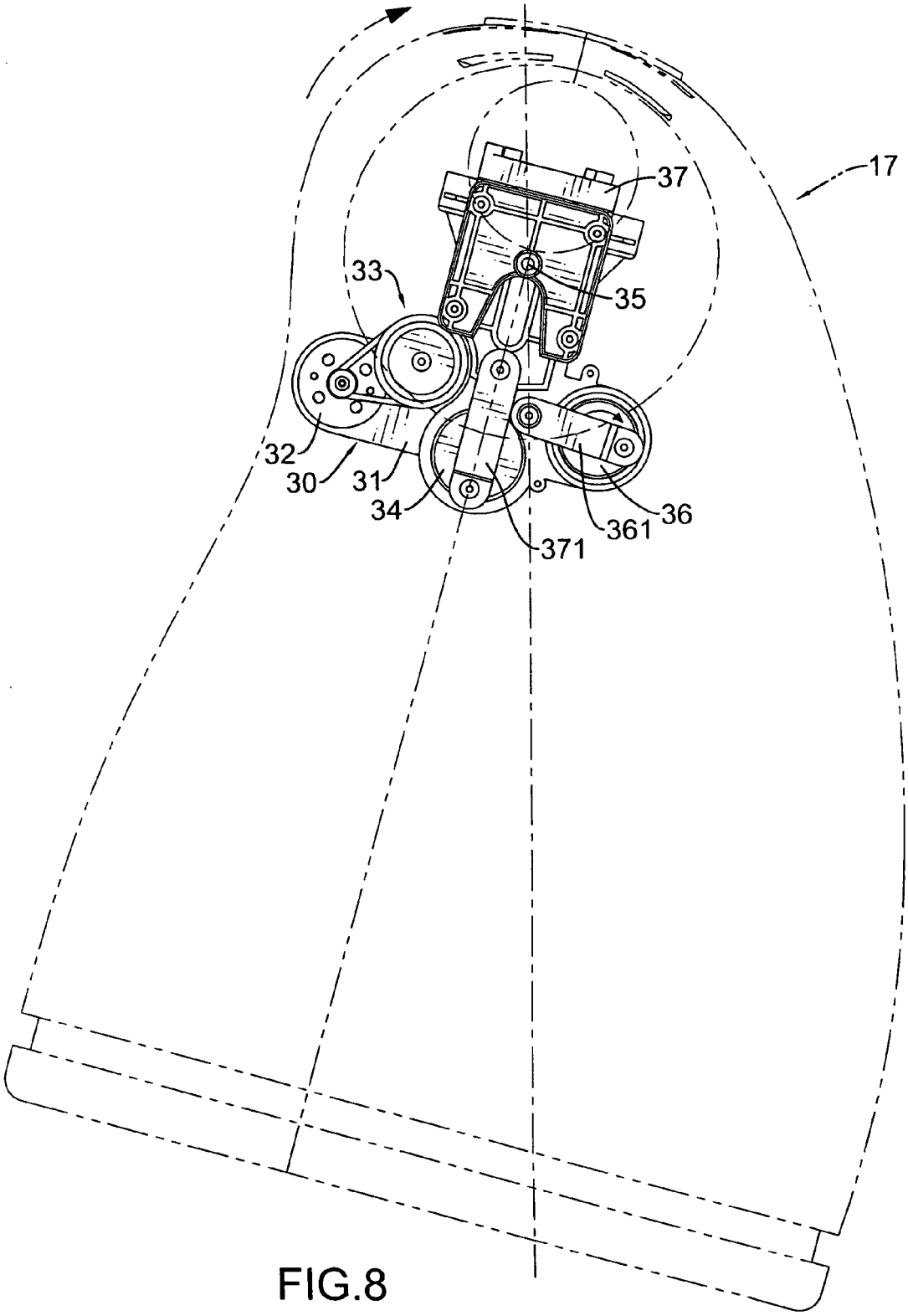
FIGS. 8 and 9 are schematic views showing the movement of the doll.
Figure 9:
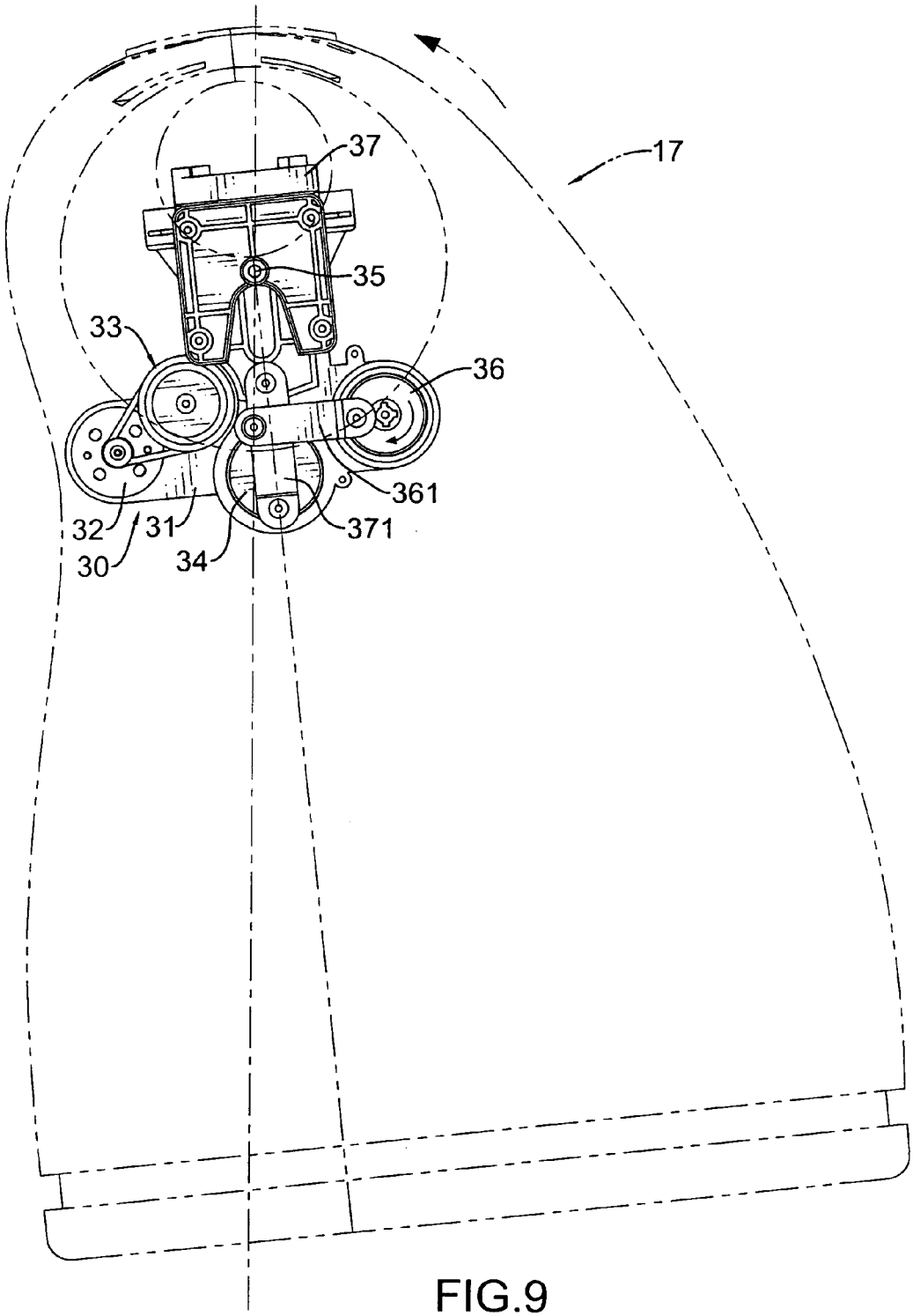

With reference to FIGS. 8 and 9 and taking FIGS. 3, 4, 5 and 6 for reference, the movement of the casing (17) from left to right is associated with the ascending and descending of the top base (16) due to the activation of the second driving device (30).

Figure 10:
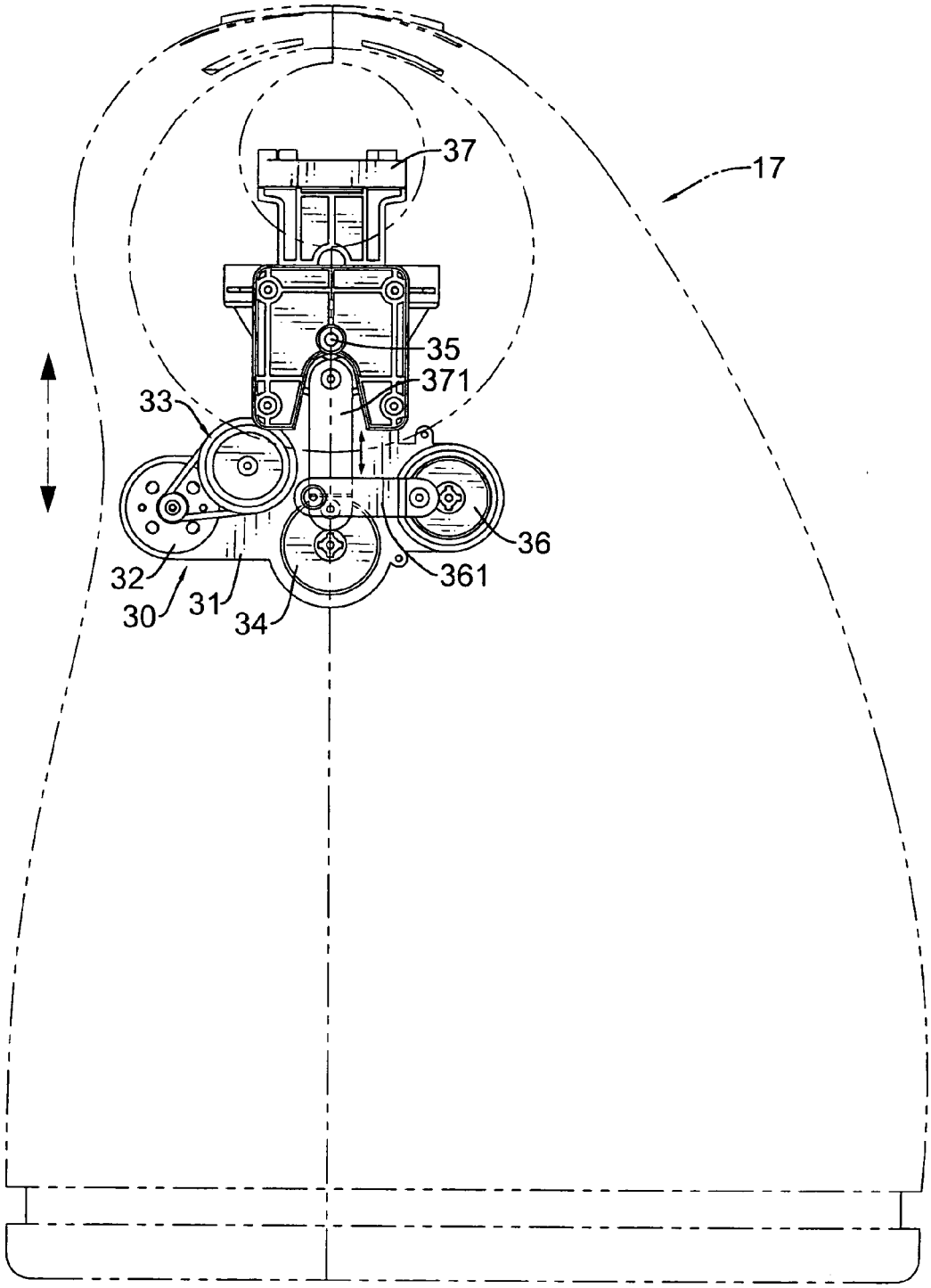
FIG. 10 is a schematic view showing the movement of the doll due to the second driving device.

After the second driving element (30) is activated, because the axle (35) is received in the first recess (218) of the rotation seat (212) and the second linkage (361) is received in the second recess (219) of the first support (214), respective movement of the first eccentric roller (34) and the second eccentric roller (36) drives the top base (16) to move lengthwise and transversely. That is, the second motor (32) is able to drive the first eccentric roller (34) and the second eccentric roller (36) via rotation of the second gear box (31) as a consequence of a rotational power transmitted by the second transmission element (33) from the second motor (32). It is noted that the rotation sleeve (21) is moved back and forth using the axle (35) as a moving center by the driving force of the second eccentric roller (36). However, the first eccentric roller (34) is able to drive the elevation plate (37) to move up and down via the elevation linkage (371), as shown in FIG. 10.

Figure 11:
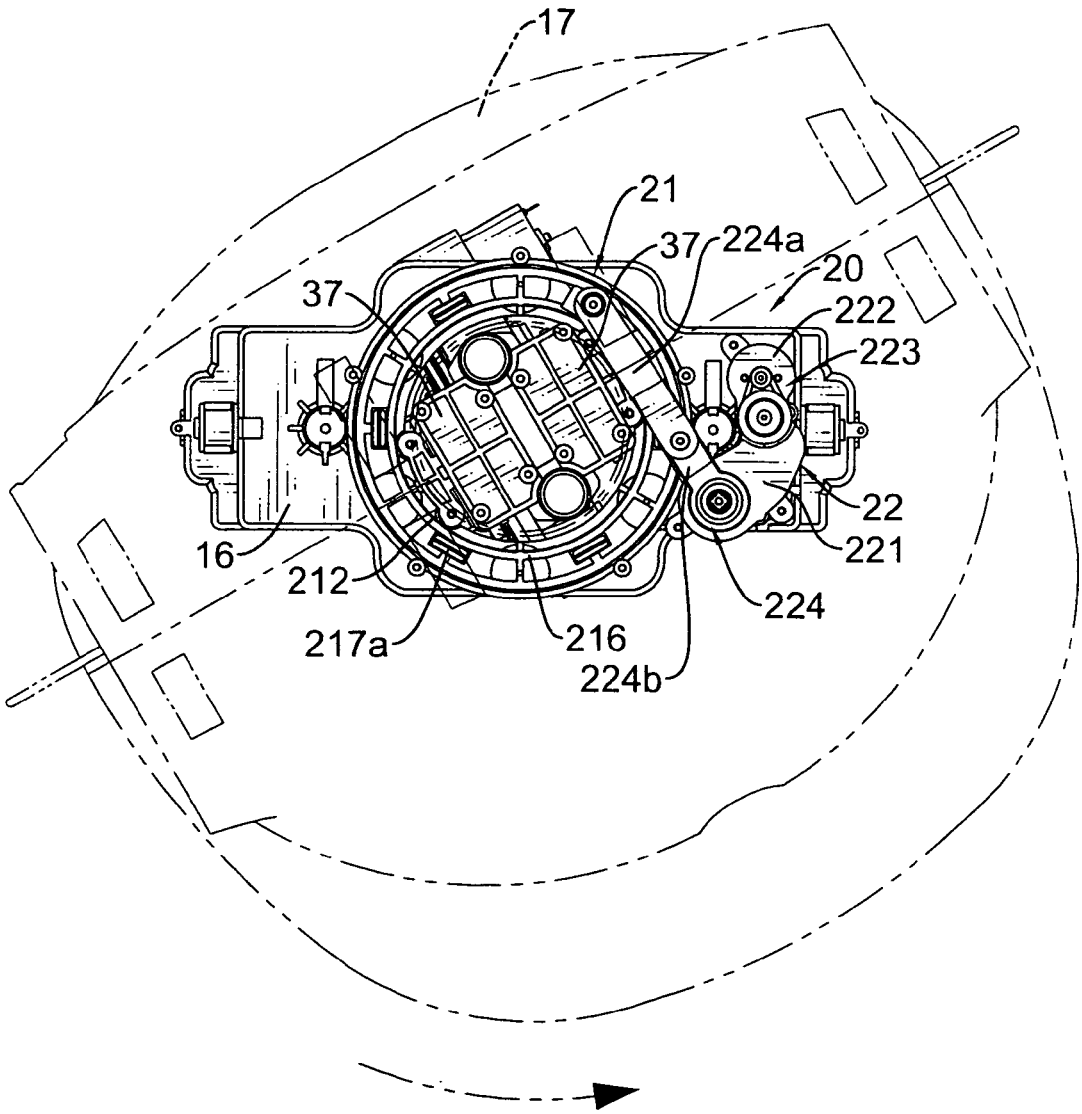
FIGS. 11 and 12 are schematic views showing the twisting movement of the doll due to the first driving device of the present invention.
Figure 12:
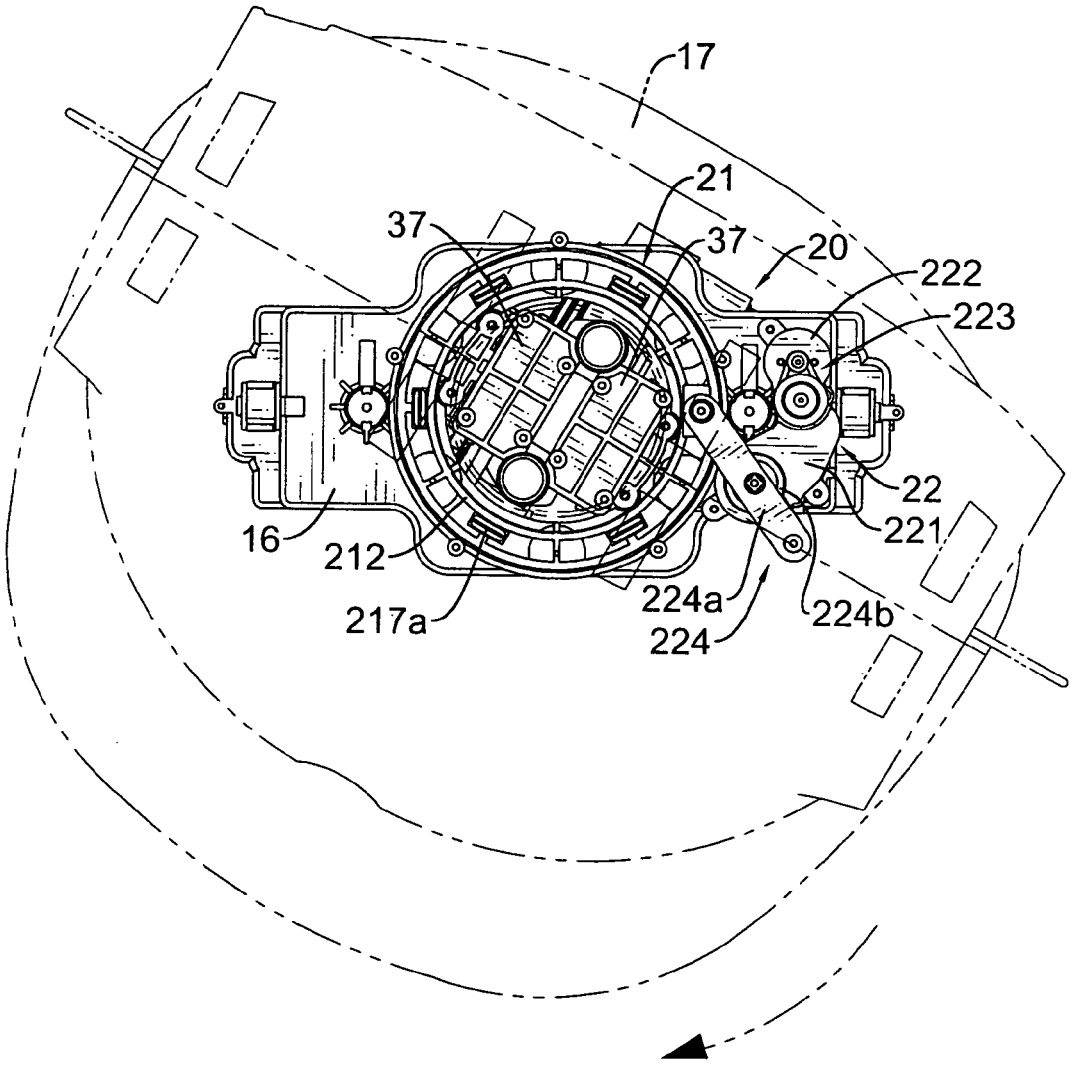

With reference to FIGS. 11 and 12, the twist of the casing (17) of the skeleton is due to the activation of the first driving device (20). The rotation seat (212) is able to twist to the right or to the left via the driving of the first motor (222) which is operably connected to the first gear box (221) via the first transmission element (213).

From the foregoing description, it is noted the doll of the present invention is able to move up and down, forward and rearward and twist to the right or to the left from the activation of the first eccentric roller (34) and/or the second eccentric roller (36). Thus the doll of the present invention is able to gyrate as required. Furthermore, if a musical instrument is attached to the doll of the present invention, as the doll moves, it appears to be playing synchronously with the music and in an eye-catching manner. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A transmission assembly for a doll having a supporting assembly composed of a bottom base provided with bottom supporting poles extending upward from a top face of the bottom base, bottom springs mounted around the bottom supporting poles, top supporting poles sandwiching therebetween a connecting member with the bottom supporting poles, top springs mounted around the top supporting poles, a top base mounted on free ends of the top supporting poles and a casing securely connected to the top base, the transmission assembly comprising:

a first driving device including a rotation sleeve adapted to be rotatably received in the top base and a twist driving element connected to the rotation sleeve to drive the rotation sleeve to twist to the right and to the left, wherein the first driving device includes a first sleeve, a rotation seat having the first sleeve mounted on top of the rotation seat, a roller seat having multiple first rollers lengthwise extending from a face of the roller seat and multiple second rollers transversely extending from the face of the roller seat, wherein the first sleeve, the rotation seat and the roller seat are adapted to be received in the top base and the first rollers and the second rollers are freely rotatable relative to the roller seat and the top base; and a second driving device including a first motor, a first gear box operable connected to the first motor via a first transmission element, a first eccentric roller in connection with the first gear box and having an axle extending out of the first eccentric roller to be rotatably received in the rotation sleeve so as to drive the top base and the casing up and down and a second eccentric roller having a first linkage extending out of the second eccentric roller to drive the top base and the casing back and forth.

2. The transmission assembly as claimed in claim 1, wherein the rotation seat has a first recess to rotatably receive therein the axle.

3. The transmission assembly as claimed in claim 2 further comprising a first support securely connected to the top base and having a second recess to rotatably receive therein the first linkage of the second eccentric roller.

4. The transmission assembly as claimed in claim 3, wherein the twist driving element comprises:

a second motor;

a second gear box operably connected to the second motor via a second transmission element; and a second linkage in connection with the second gear box and the rotation seat to drive the rotation sleeve to twist to the right and the left.

5. The transmission assembly as claimed in claim 2, wherein the twist driving element comprises:

a second motor;

a second gear box operably connected to the second motor via a second transmission element; and a second linkage in connection with the second gear box and the rotation seat to drive the rotation sleeve to twist to the right and the left.

6. The transmission assembly as claimed in claim 1, wherein the twist driving element comprises:

a second motor;

a second gear box operably connected to the second motor via a second transmission element; and a second linkage in connection with the second gear box and the rotation sleeve to drive the rotation sleeve to twist to the right and the left.

7. The transmission assembly as claimed in claim 1, wherein the twist driving element comprises:

a second motor;

a second gear box operably connected to the second motor via a second transmission element; and a second linkage in connection with the second gear box and the rotation seat to drive the rotation sleeve to twist to the right and the left.

* * * * *